US007284286B1

(12) United States Patent
Kopplin et al.

(10) Patent No.: US 7,284,286 B1
(45) Date of Patent: Oct. 23, 2007

(54) TOILET DISCHARGE VALVE

(75) Inventors: Charles R. Kopplin, Sheboygan, WI (US); Thomas C. Jorsch, Sheboygan, WI (US); Benjamin W. Marotz, Kohler, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 11/525,556

(22) Filed: Sep. 22, 2006

(51) Int. Cl.
*E03D 11/10* (2006.01)

(52) U.S. Cl. ..... 4/441; 4/438

(58) Field of Classification Search ..... 4/434, 4/435, 438, 440–442, 348
See application file for complete search history.

(56) References Cited

U.S. PATENT DOCUMENTS 168,613 A 10/1875 Carr
209,996 A * 11/1878 Wellington ..... 4/438
234,570 A 11/1880 Hellyer
258,454 A * 5/1882 Johnson ..... 137/430
279,048 A 6/1883 Tweeddale
283,172 A * 8/1883 Walsh ..... 4/438
299,333 A 5/1884 Birkett
717,651 A * 1/1903 Allen ..... 4/438
4,016,609 A 4/1977 Graham

* cited by examiner

*Primary Examiner*—Huyen Le
(74) *Attorney, Agent, or Firm*—Quarles & Brady

(57) ABSTRACT

Disclosed are valve assemblies for controlling flow from a toilet bowl to a trap way. In one form there is a cartridge unit in which a pivotable gate is mounted. The gate can swing from a blocking/closing position to a position in which it is essentially hidden away in a recess out of the main flow path. The surface of the gate facing the bowl is inwardly dished to further facilitate flow optimization.

5 Claims, 9 Drawing Sheets

TOILET DISCHARGE VALVE

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to toilets, and more particularly to toilet valves controlling the outflow of waste from a toilet bowl to a toilet trap.

Although flushing toilets greatly aid in the sanitary disposal of human excrement, water usage is impacted by such devices. As the need and desire to conserve water increases, there is a corresponding desire to reduce the volume of water used per average flush of a toilet.

A typical toilet includes a valve upstream of the toilet bowl, such as at the bottom of a water storage tank. When the toilet is flushed, the valve in the water tank opens, and the tank water is able to flush into the toilet bowl.

With these conventional toilets there is typically a delay between the beginning of the flushing cycle and the time that most of the crude waste has been removed from the bowl. An undesirably large amount of flushing water is required just to move the main waste out of the bowl, and a further amount is needed to provide the final rinse.

One way of reducing this problem is to provide a trap configured with an inlet valve and shaped such that when the inlet valve is opened most of the waste water will drop out of the bowl regardless of any new flush water entering. Examples of this approach include U.S. Pat. Nos. 168,613, 234,570, 279,048, 299,333, and 4,016,609.

However, such valves are necessarily placed in a blocking position relative to the outflow of waste from the bowl. Even when fully open they typically impede the flow of fluid and waste out of the bowl to some extent. Moreover, they sometimes result in clogging, maintenance or wear problems. Also, they may be expensive to produce or install, or be unreliable over prolonged usage.

For example, U.S. Pat. No. 4,016,609 disclosed a toilet having a bendable member for controlling waste outflow from a toilet basin. The resiliency of the bendable member was critical for proper operation, which resiliency could degrade over time. Additionally, the valve was not easily installed into the toilet.

Hence, a need still exists for improved toilet trap valve assemblies, particularly those which facilitate flushing with reduced amounts of water.

SUMMARY OF THE INVENTION

In one aspect the present invention provides a toilet having a bowl with a discharge outlet, a trap in fluid communication with the discharge outlet, and a valve positioned to control outflow from the discharge outlet to the trap. This valve is in the form of a cartridge unit having a first housing part, a second housing part linked to the first housing part so as to define a cavity there between, and a pivotable gate positioned in the cavity so as to be able to swing between a first position essentially closing off flow through the discharge outlet to a second position permitting flow from the discharge outlet to the trap.

Particularly in accordance with the present invention the cavity has a recess along one of its walls. When the pivotable gate is in the second position a portion of the pivotable gate is housed in the recess. This helps move the gate out of the way and thereby increases the efficiency of the water force flowing out of the bowl. This then further reduces the need for as much water to complete an effective flushing cycle.

In preferred forms of the invention pivoting of the pivotable gate can be driven by movement of a mechanical or hydraulic linkage that extends outside of the housing parts. This can be connected to a controller which also controls initiation and ending of the water flush.

In other preferred forms the pivotable gate carries a deformable seal suitable to seal against a housing part when the pivotable gate is in the first position, and the pivotable gate has an inwardly dished side facing the toilet bowl when the pivotable gate is in the first position. This helps the flow when the gate is in the open position to occur much more smoothly. There can also be an outwardly dished side of the gate which is configured to face a housing part when the pivotable gate is in the second position.

In another preferred aspect of the invention the trap has a normal trap water level to restrict back flow of sewer gases to the bowl, and the pivotable gate is positioned above that water level. Further, the valve cartridge can provide a flow path that bends from an essentially vertical path adjacent the bowl discharge outlet to a path at least somewhat horizontal.

In another aspect of the invention the invention can provide such a cartridge valve suitable to connect to such a toilet.

In a further aspect of the invention there can be provided a toilet trap way for carrying waste from a toilet bowl to a toilet trap. The trap way has a gate valve at its inlet end in the form of a pivotable gate movable between a first position essentially closing off flow through the trap way and a second position permitting flow through the trap way. The trap way has a recess along one of its walls and when the pivotable gate is in the second position a portion of the pivotable gate can be housed in the recess.

The present invention advantageously reduces the amount of water needed to complete a flush cycle with a given degree of cleaning. Further, the incidence of maintenance problems is reduced by keeping the gate above the normal trap water level in an air pocket. Further, if maintenance issues arise, the valve cartridge can be replaced without having to dispose of the trap or bowl when the cartridge unit forms of the valve are used.

These and still other advantages of the present invention will be apparent from the detailed description which follows and the accompanying drawings.

DETAILED DESCRIPTION OF THE PREFERRED EMBODIMENTS

Figure 1:
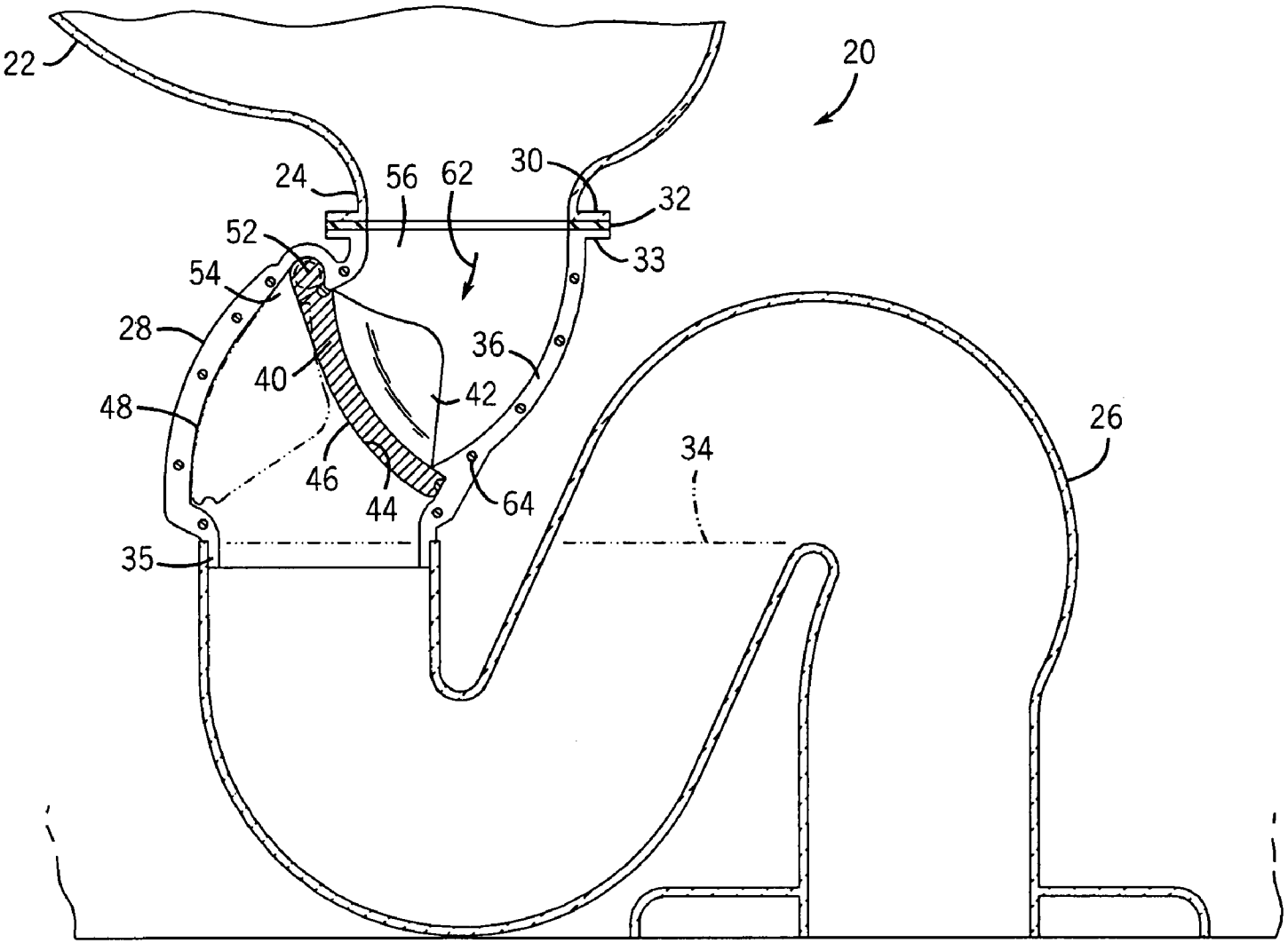
FIG. 1 is a vertical cross-sectional view through a toilet in which is installed an embodiment of the present invention.
Figure 2:
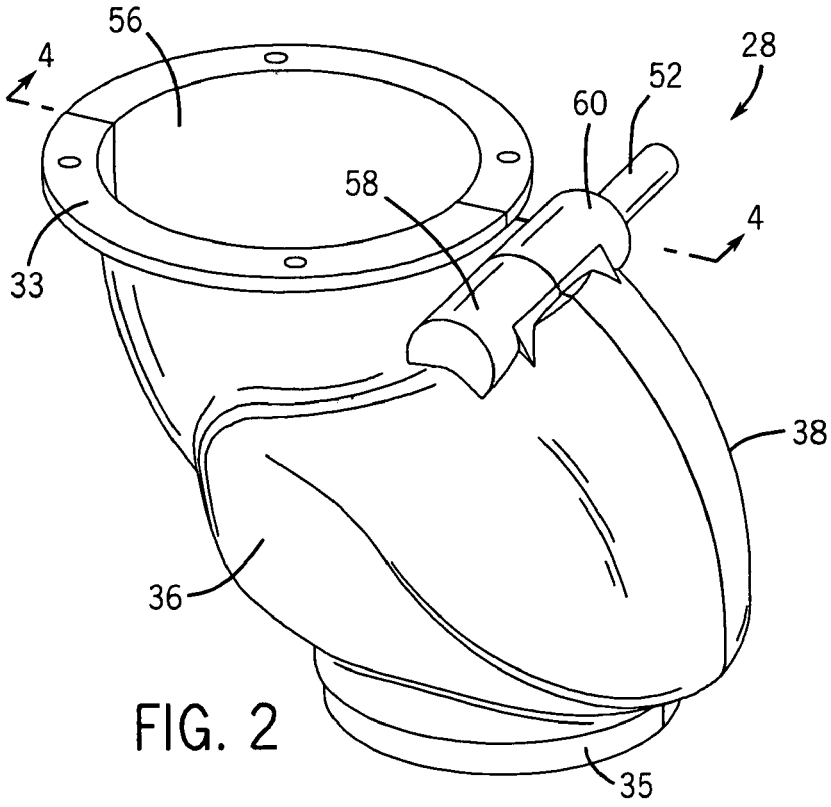
FIG. 2 is a perspective view of an outlet valve of FIG. 1.
Figure 3:
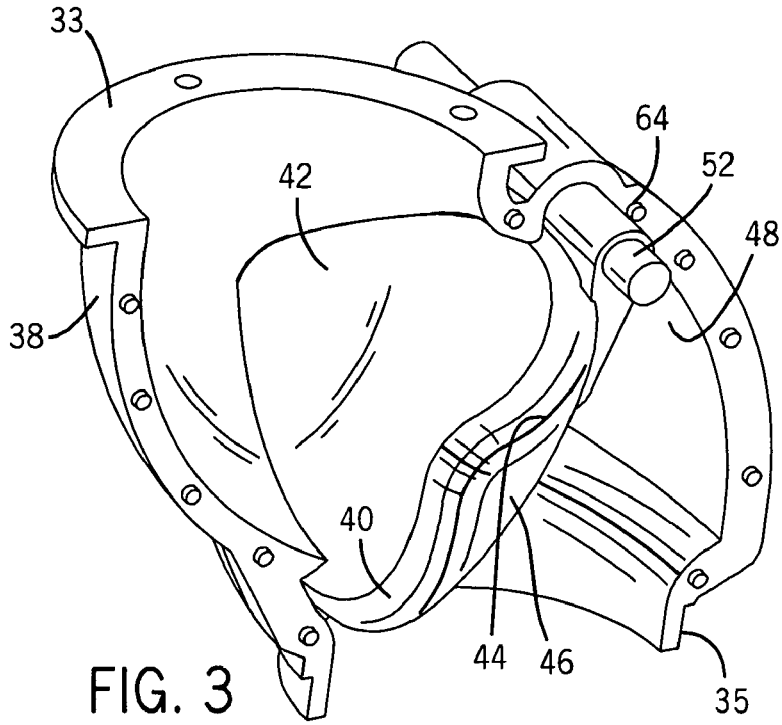
FIG. 3 is a perspective view of one of the housing halves, and the gate, of the valve of FIG. 2.

Referring first to FIG. 1, there is shown the lower portion of a toilet 20 which includes a bowl 22 having a discharge outlet 24, a trap 26 in fluid communication with discharge outlet 24, and a discharge valve cartridge 28 in accordance with the present invention located between bowl 22 and trap 26.

Toilet 20 will typically include other elements such as a water tank or other water supply source (not shown), a seat, a lid and/or other covering elements on the bowl (again all not shown). A control mechanism (again not shown) can be mechanically or otherwise linked to a flush mechanism which both starts the flush cycle and pivots the gate 40 from a closed position to an open one, and then back again. Alternatively, one could manually move the gate by rotating stem 52 manually.

Toilet 20 can include a flange 30 near the bottom of bowl 22, and/or other connecting elements such as fasteners (not shown), and a gasket 32, for connecting valve cartridge 28 at flange 33. In any event, trap 26 has a trap water level 34 for preventing return of sewer gas, and can be connected to valve cartridge 28 at collar 35 with a flexible piece of rubber and/or other elements such as clamps (all not shown). Valve cartridge 28 permits the passage of waste and fluid from bowl 22 to trap 26.

Referring more particularly to FIGS. 2-5, valve cartridge 28 includes a first housing part 36, a second generally mirror image housing part 38 connected to first housing part 36, and a pivotable gate 40 mounted inside a cavity defined between the first and second housing parts 36/38.

Gate 40 includes an inwardly dished side 42 and an outwardly dish side 44 which includes a contour 46. The contour 46 mimics a contour 48 formed on the inside wall of the cavity formed by the housing parts.

Figure 4:
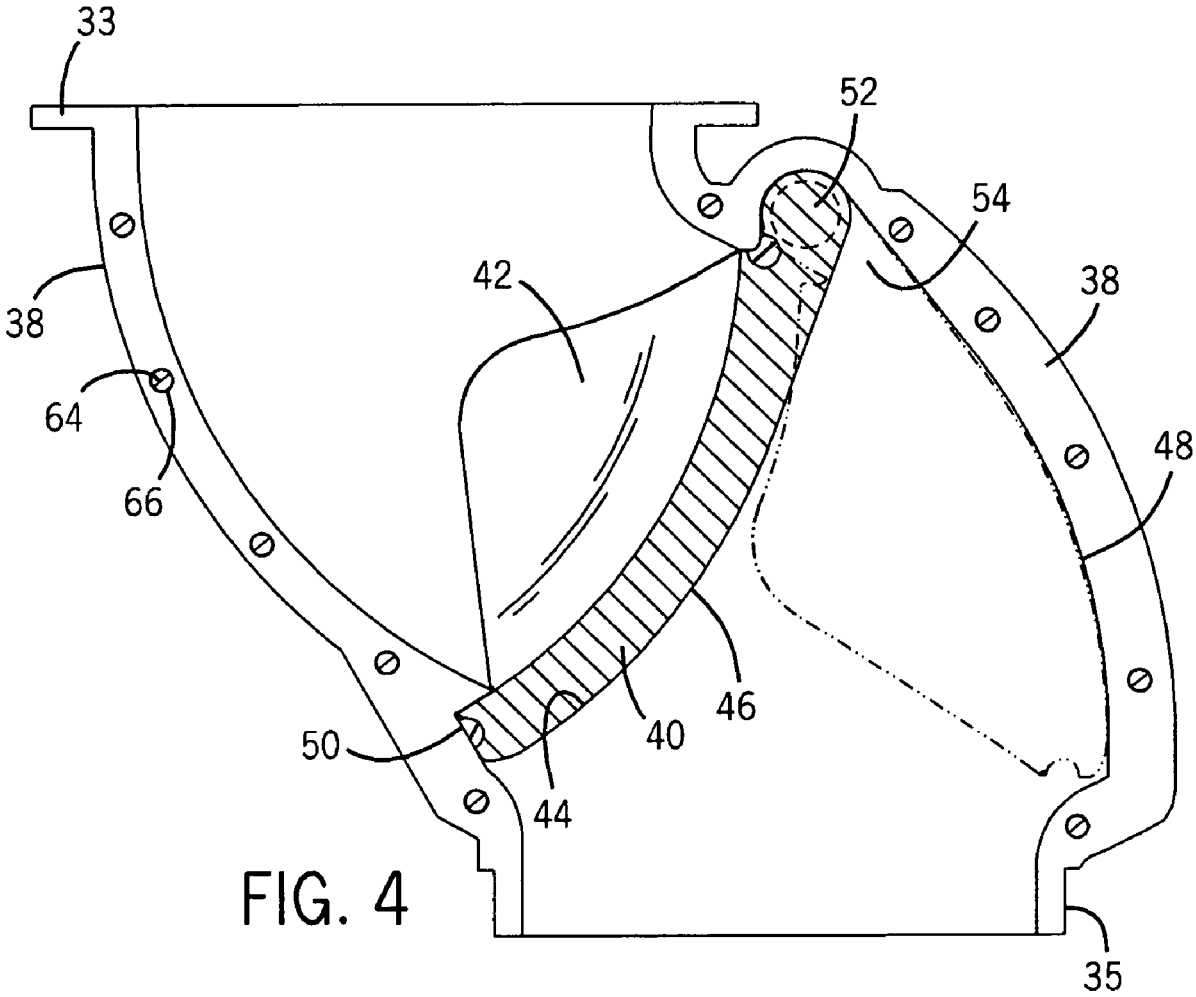
FIG. 4 is an enlarged cross-sectional view taken along line 4-4 of FIG. 2.
Figure 5:
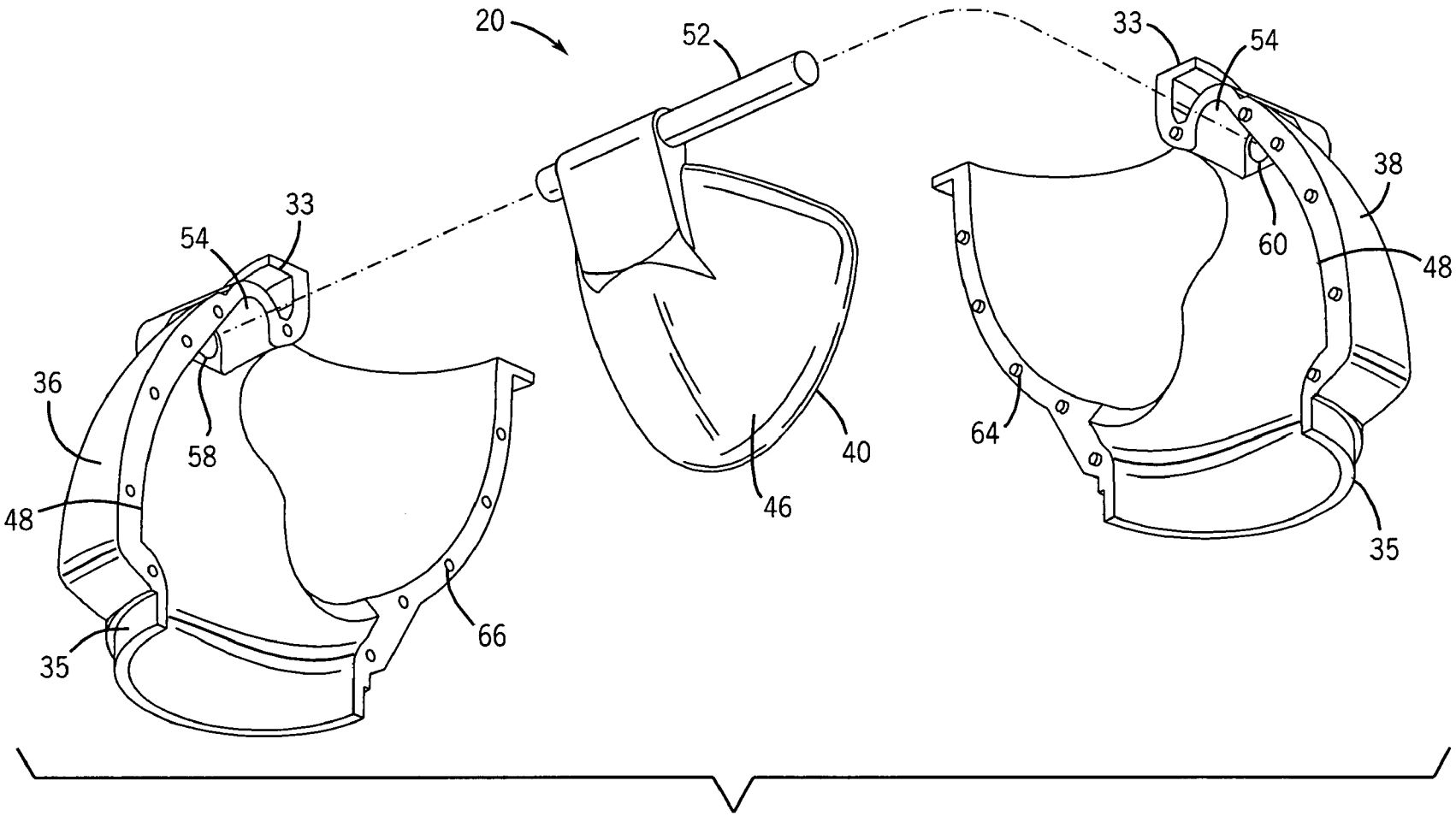
FIG. 5 is an exploded perspective view of the valve of FIG. 2.

As shown in FIG. 4, when gate 40 is pivoted by rotatable stem 52, it pivots down and against contour 48. This moves the gate out of the blocking/sealing position.

It should be appreciated that between flushes waste material will not normally stay in the trap above trap water level 34. Thus, waste won't typically collect against contour 48. Note also that valve cartridge 28 has a gasket 50 to help maintain a proper seal between the outer edge of the gate and the trap wall. Note further that the presence of an air pocket 54 also facilitates maintenance of the stem 52.

During a flushing cycle, one trips a flush initiator which ultimately pivots the gate 40 out of the closed position permitting waste to rapidly evacuate through inlet 56 of the valve cartridge. It is preferred that the start of the flush water will be delayed slightly to permit most of the evacuation to occur before clean flush water starts to rinse the bowl.

After a defined period the flap valve will return to the FIG. 1 closed position, and preferably be latched in that position so that some water can be positioned in the bowl above the flap between flushes. The inlet water will then be shut off, ending the flush cycle.

Stem 52 is inserted into socket 58, and through socket 60 for connection to a torque element (not shown) as was previously discussed. The first housing part 36 and second housing part 38 are preferably joinable along a plane approximately parallel to a direction of flow 62. Pins 64 in second housing part 38, and corresponding holes 66 in first housing part 36, allow for proper alignment of the two housings 36, 38.

Figure 6:
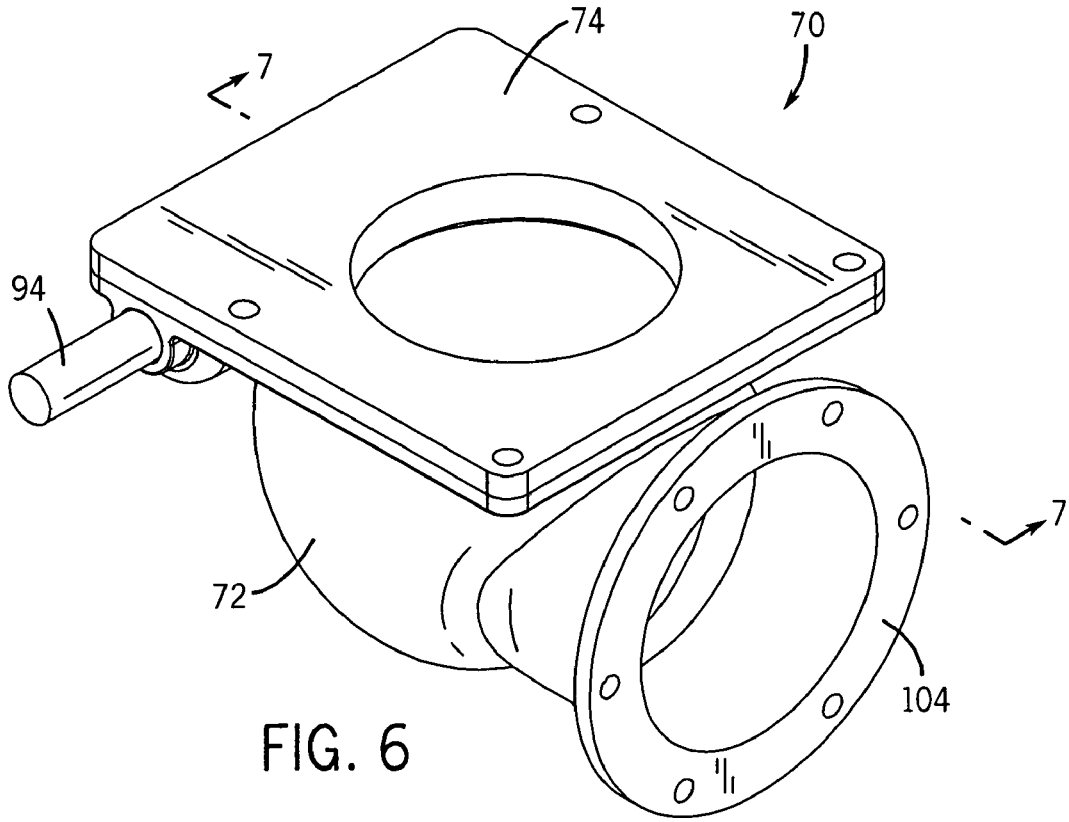
FIG. 6 is a perspective view of a second embodiment of a valve according to the present invention.
Figure 7:
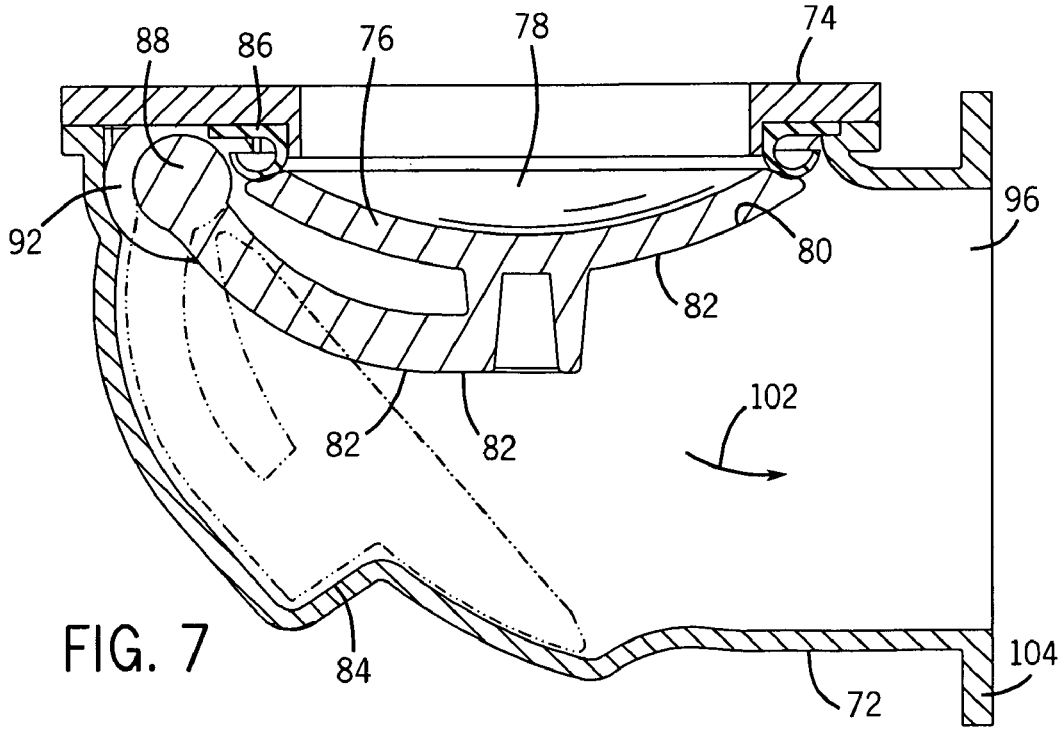
FIG. 7 is a cross-sectional view taken along line 7-7 of FIG. 6.
Figure 8:
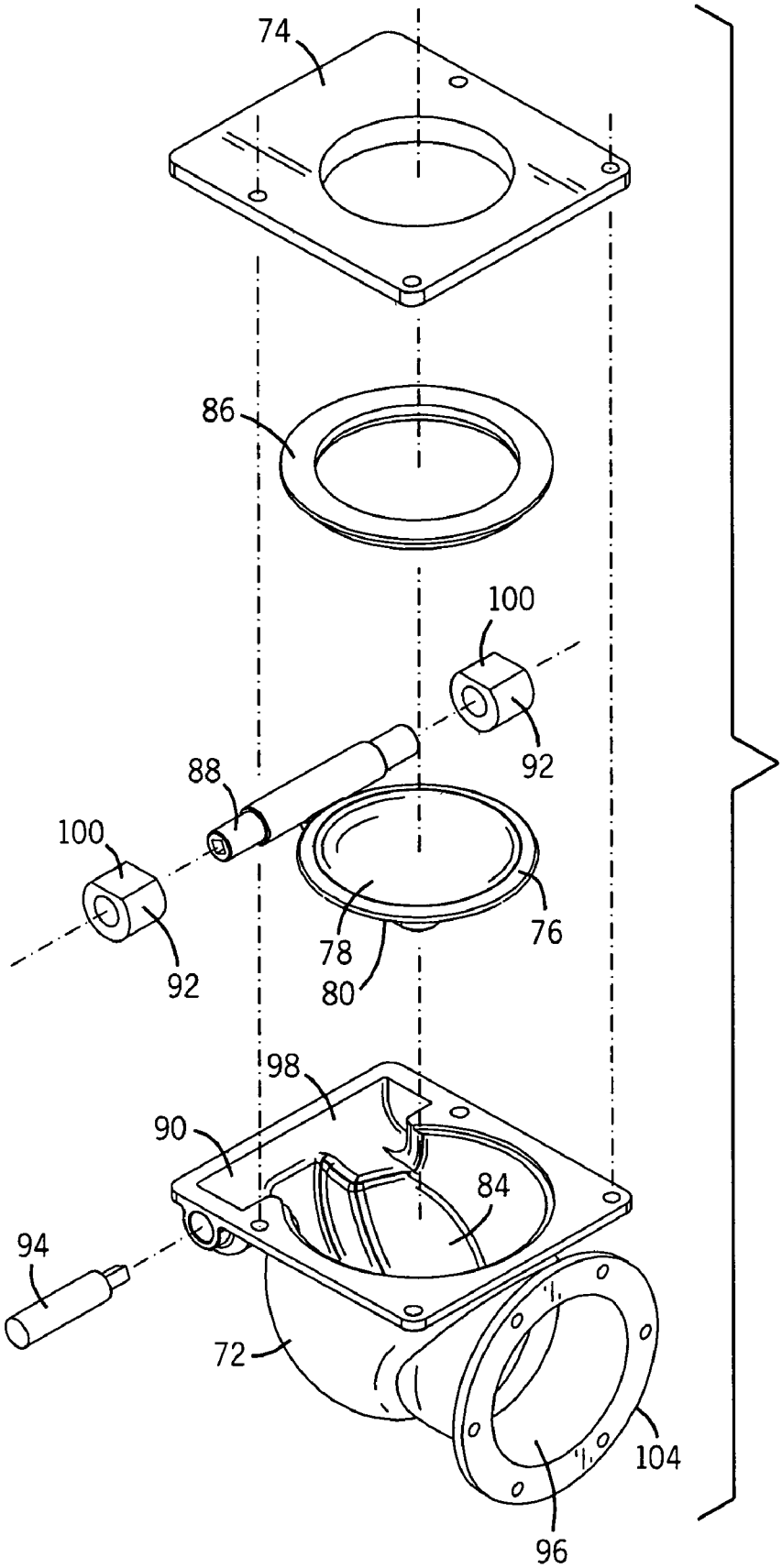
FIG. 8 is an exploded perspective view of the valve of FIG. 6.

Referring now to FIGS. 6-8, a second discharge valve 70 can be used with a toilet (not shown). It has a 90° elbow bend between the discharge outlet of the bowl and the beginning of a trap or other waste conduit.

Discharge valve 70 does not have two mirror image housing halves. Rather, there is a main housing part 72, a covering housing part 74. There is, however, still a pivotable gate 76 installed between the parts 72/74.

Gate 76 includes an inwardly dished side 78 facing the bowl (when the valve is closed) and an outwardly dished side 80 facing the trap, where side 80 includes a contour 82. First housing part 72 includes a recess 84 complementary in shape to contour 82.

When gate 76 opens it pivots into recess 84, and contour 82 positions in recess 84. This reduces resistance to flow, and prevents waste material from collecting behind gate 76.

Discharge valve 70 has a valve gasket 86 to help maintain a proper seal, and a shaft 88 connected to gate 76. Note also air pocket 90 and bushings 92. Pin 94 can connect into shaft 88 for connection to a torque element (not shown) as previously discussed.

Discharge valve 70 includes a main flow channel indicated at 96, and air pocket 90 is located offset from main flow channel 96 and above the trap water level. Shaft 88 is inserted into bushings 92, and placed in shaft channel 98, where second housing part 74 constrains the flat surfaces 100 of bushings 92, and shaft 88, and correspondingly gate 76, rotate within bushings 92.

First housing part 72 and second housing part 74 are joinable along a plane transverse to direction of flow 102, and can be connected to the toilet bowl at second housing part 74, and to the trap at flange 104 using a variety of fasteners (not shown).

Figure 9:
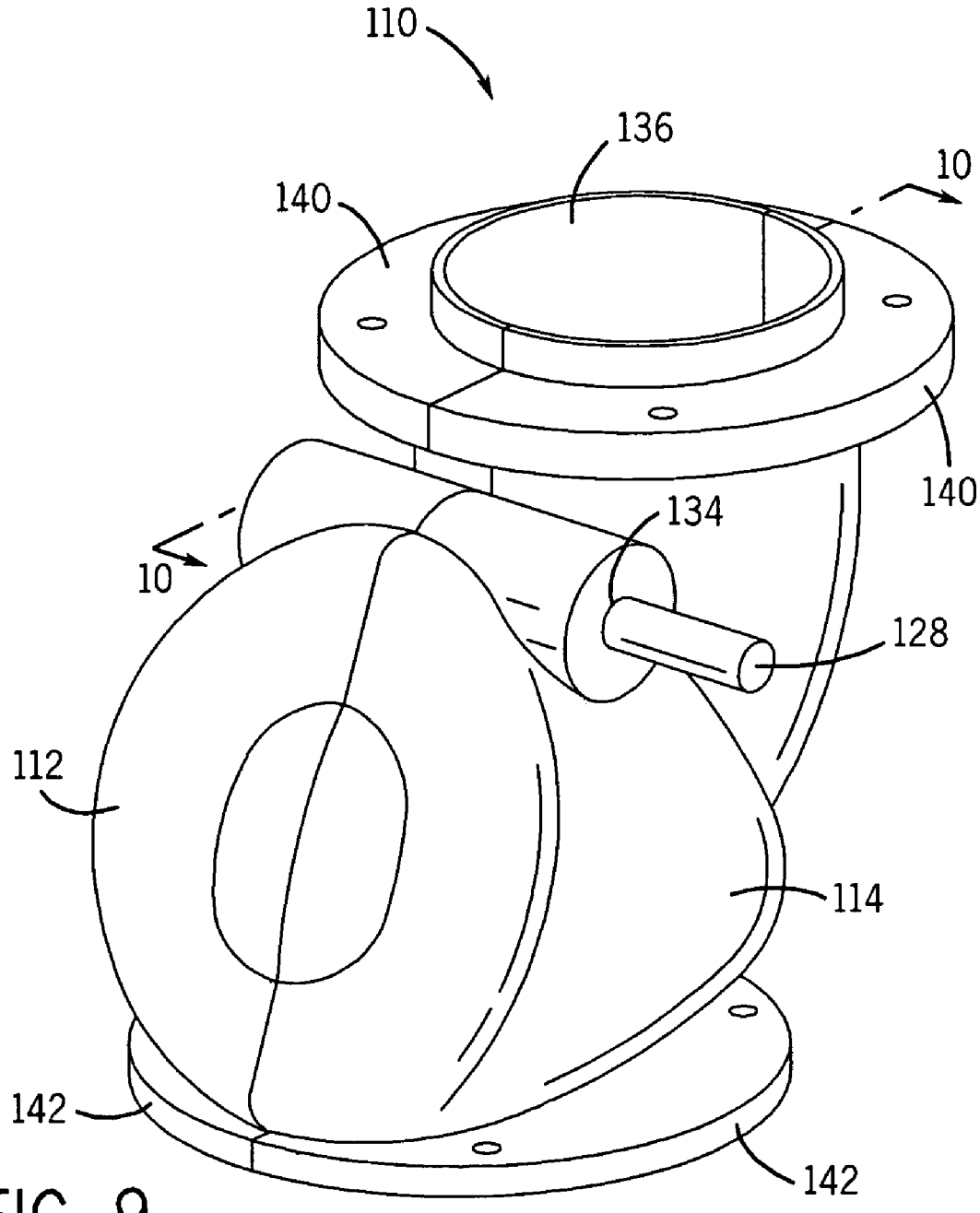
FIG. 9 is a perspective view of a third embodiment of a valve according to the present invention.
Figure 10:
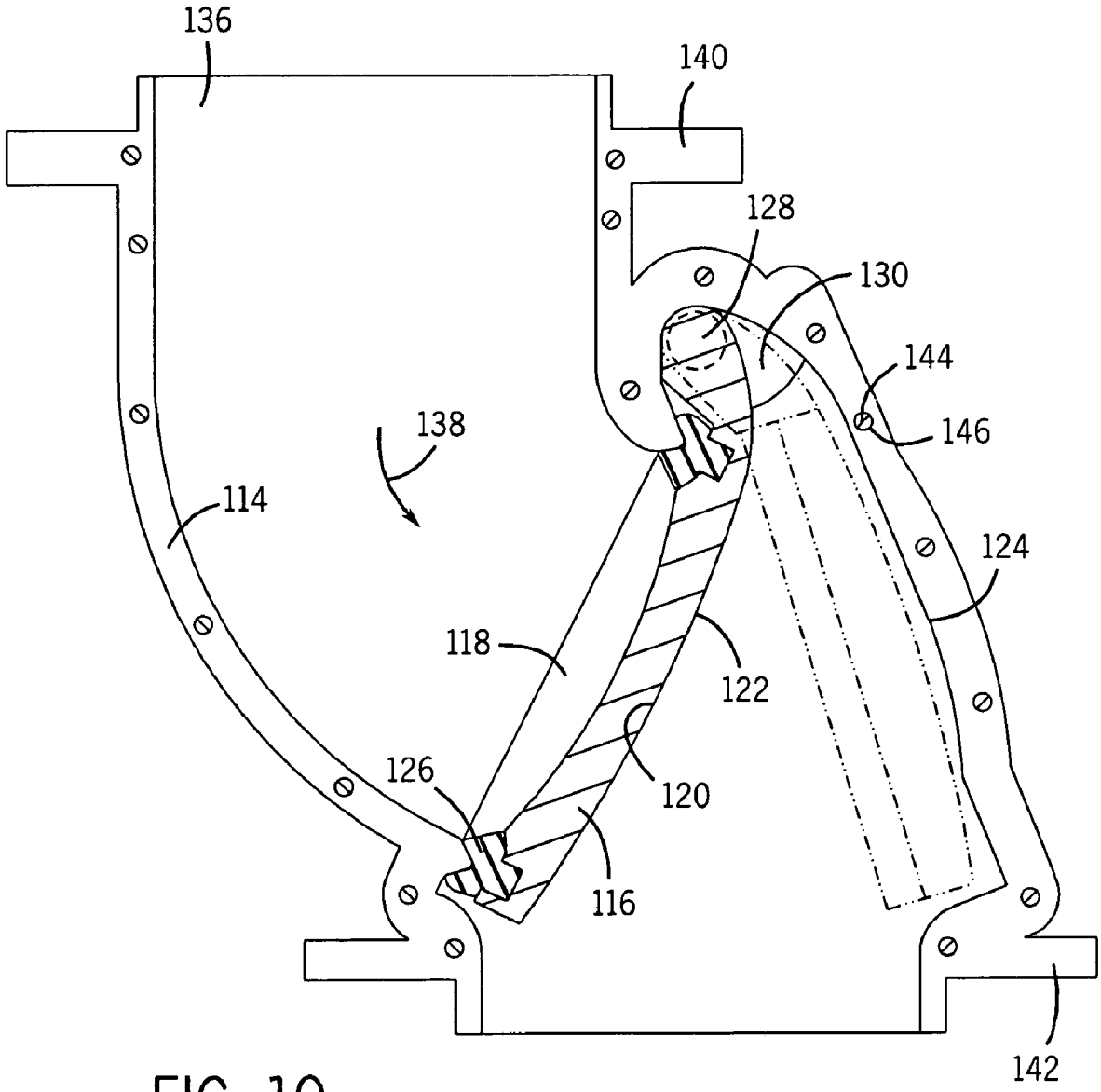
FIG. 10 is a cross-sectional view taken along line 10-10 of FIG. 9.
Figure 11:
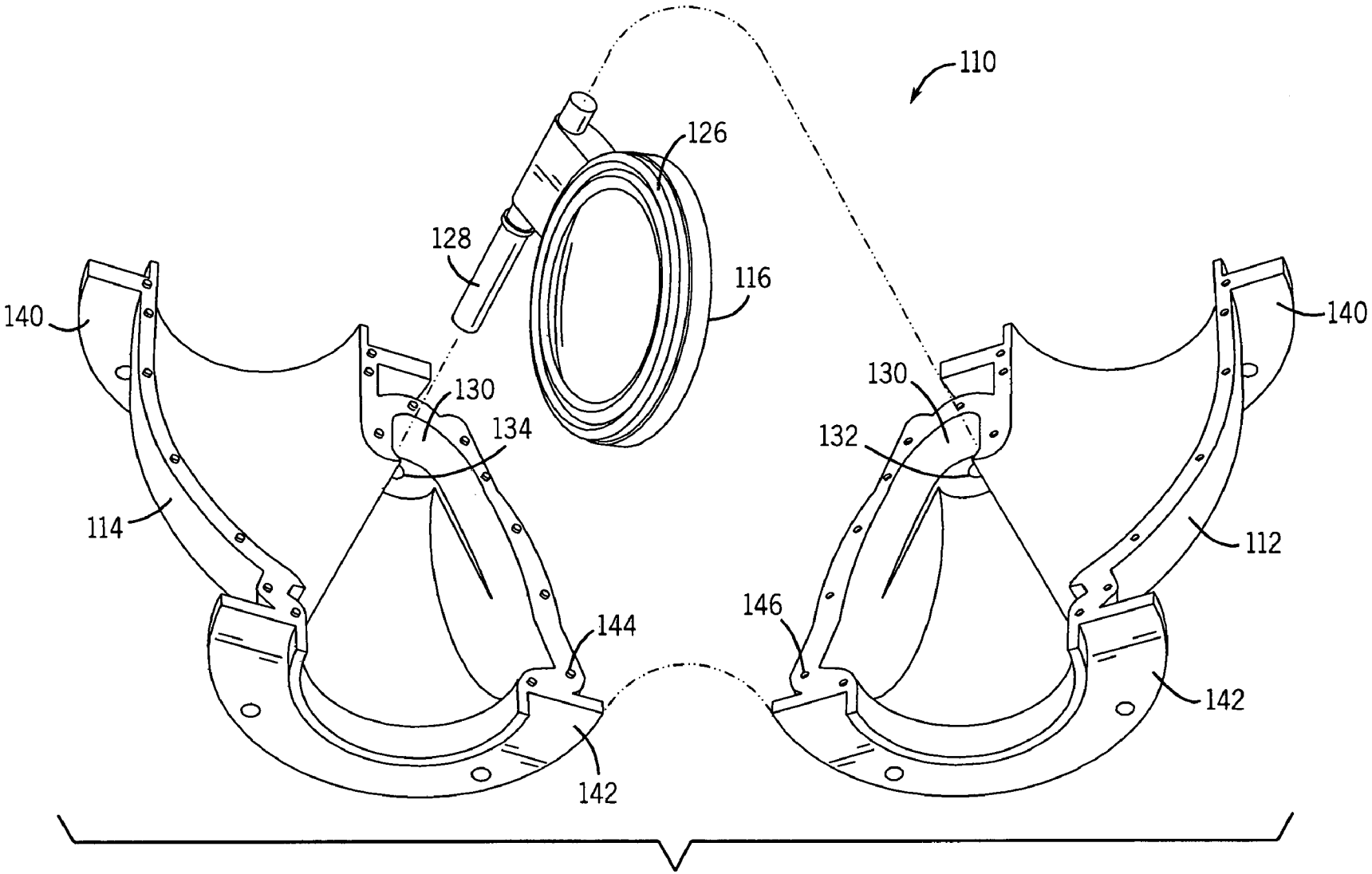
FIG. 11 is an exploded perspective view of the valve of FIG. 9.

Referring now to the embodiment of FIGS. 9-11, valve 110 can be positioned in replacement for valve cartridge 28 in fluid communication with a toilet bowl and trap. It primarily differs with respect to its seal configuration on its flap.

There is a first housing part 112, a second housing part 114 connected to first housing part 112, and a pivotable gate 116 mounted there between. Gate 116 includes a side 118 and a side 120, where side 120 includes a contour 122. Housing parts 112, 114 include a recess 124 for tightly receiving contour 122.

Valve 110 has a valve gasket 126 to help maintain a proper seal. There is also a shaft 128 connected to gate 116. First housing part 112 includes an air pocket 130. Shaft 128 is connected to housing parts 112, 114 in air pocket 130 at sockets 132, 134, respectively.

Shaft 128 can be connected to a torque element (not shown) as previously discussed. Valve 110 includes a main flow channel indicated at 136, and air pocket 130 is located offset from main flow channel 136 and above the trap water level. First housing part 112 and second housing part 114 are joinable along a plane approximately parallel to direction of flow 138.

Valve 110 connects to the toilet bowl at flange 140, and connects to the trap at flange 142, and in both instances can use a variety of fasteners (not shown). Pins 144 in second housing part 114, and corresponding holes 146 in first housing part 112, allow for proper alignment of the two housings 112, 114.

Regardless of the embodiment, the flap valve can be housed in a separate cartridge unit which facilitates assembly and replacement if needed. Further, the likelihood of maintenance being needed is reduced by minimizing the exposure of the flap valve rear side to waste.

While preferred embodiments of the present invention have been disclosed, it should be appreciated that still other modifications and variations to the preferred embodiments will be apparent to those skilled in the art, and are intended to be within the spirit and scope of the invention. For example, while the trap valve could be used with a metallic bowl and/or trap, it could also be used with toilet components made of other materials (e.g. vitreous; plastics). Further, the concave/convex nature of the trap and rear side of the flap can be reversed.

Therefore, the present invention is not to be limited to just the described most preferred embodiments. To ascertain the full scope of the invention, the claims which follow are referenced.

INDUSTRIAL APPLICABILITY

The invention provides toilets which have a discharge valve controlling flow from the bowl to the trap, where the discharge valve is designed to reduce impingement on water flow during the flush cycle.

We claim:

1. A toilet, comprising:

a bowl having a discharge outlet;

a trap in fluid communication with said discharge outlet; and a valve positioned to control outflow from the discharge outlet to the trap;

wherein the valve comprises a cartridge unit having a first housing part, a second housing part linked to the first housing part so as to define a cavity there between, the cartridge unit having an inlet at one end of the cavity and an outlet at another end of the cavity, the cartridge unit inlet being detachable and retachable to the bowl discharge outlet, the cartridge unit outlet being detachable and retachable to the trap, and a pivotable gate positioned in the cavity so as to be able to move between a first position essentially closing off flow through the discharge outlet to a second position permitting flow from the discharge outlet to the trap, the pivotable gate having an outer contour on a side of the pivotable gate opposite the cartridge unit inlet;

wherein the cavity has a recess along one of its walls the recess having an inner contour essentially complementary in shape with the outer contour of the pivotable gate, and when the pivotable gate is in the second position the outer contour of the pivotable gate is positioned adjacent the inner contour; and wherein said valve cartridge provides a flow path that bends from an essentially vertical path adjacent the bowl discharge outlet to a path at least somewhat horizontal.

2. The toilet of claim 1, wherein pivoting of the pivotable gate can be caused by movement of a linkage that extends outside of the housing parts and into the cavity.

3. The toilet of claim 1, wherein the pivotable gate carries a seal suitable to seal against a housing part when the pivotable gate is in the first position.

4. The toilet of claim 1, wherein the pivotable gate includes an inwardly dished side facing the toilet bowl when the pivotable gate is in the first position, and an outwardly dished side configured to face a housing part when the pivotable gate is in the second position.

5. The toilet of claim 1, wherein said trap has a normal trap water level to restrict back flow of sewer gases to the bowl, and the pivotable gate is positioned so as to always be above that water level.

* * * * *